US007775638B2

(12) United States Patent
Hirosawa et al.

(10) Patent No.: US 7,775,638 B2
(45) Date of Patent: Aug. 17, 2010

(54) INK JET RECORDING HEAD AND RECORDING APPARATUS

(75) Inventors: Toshiaki Hirosawa, Kanagawa (JP); Shuzo Iwanaga, Kanagawa (JP); Yasutomo Watanabe, Kanagawa (JP); Riichi Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 882 days.

(21) Appl. No.: 11/628,334

(22) PCT Filed: Jul. 14, 2005

(86) PCT No.: PCT/JP2005/013438

§ 371 (c)(1),
(2), (4) Date: Dec. 4, 2006

(87) PCT Pub. No.: WO2006/009235

PCT Pub. Date: Jan. 26, 2006

(65) Prior Publication Data

US 2007/0242101 A1 Oct. 18, 2007

(30) Foreign Application Priority Data

Jul. 22, 2004 (JP) ..... 2004-214240

(51) Int. Cl.
*B41J 2/05* (2006.01)
*B41J 2/14* (2006.01)

(52) U.S. Cl. ..... 347/58; 347/50

(58) Field of Classification Search ..... 347/57–59, 347/17, 20, 29, 40–44, 47–48, 50, 54, 56, 347/85–87

See application file for complete search history.

(56) References Cited

U.S. PATENT DOCUMENTS

| | | | | |
|---|---|---|---|---|
| 5,227,812 | A | 7/1993 | Watanabe et al. | |
| 5,576,748 | A | 11/1996 | Tamura | 347/58 |
| 5,696,543 | A | 12/1997 | Koizumi et al. | 347/17 |
| 6,084,612 | A * | 7/2000 | Suzuki et al. | 347/50 |
| 6,113,214 | A | 9/2000 | Hirosawa et al. | 347/42 |
| 6,123,410 | A | 9/2000 | Beerling et al. | |

(Continued)

FOREIGN PATENT DOCUMENTS

| | | |
|---|---|---|
| JP | 11-192705 | 7/1999 |

(Continued)

*Primary Examiner*—K. Feggins
(74) *Attorney, Agent, or Firm*—Fitzpatrick, Cella, Harper & Scinto

(57) ABSTRACT

A highly reliable, small-sized, and inexpensive ink jet recording head includes an electrical wiring member that is joined with a back surface of a liquid discharge substrate and includes a liquid supply port communicating with a liquid supply port of the liquid discharge substrate and an electrical connection portion connected to the electrode; and a holding member that holds the liquid discharge substrate through the electrical wiring member and includes a liquid supply port for supplying the liquid to the liquid supply port of the liquid discharge substrate. The liquid supply ports of the electrical wiring member, the liquid discharge substrate, and the holding member communicate with one another. A sealing agent for sealing the electrical connection portion is filled up between the liquid discharge substrate and the electrical wiring member, and a side surface of the liquid supply port of the electrical wiring member is covered with the sealing agent.

6 Claims, 15 Drawing Sheets

U.S. PATENT DOCUMENTS

| | | | | |
|---|---|---|---|---|
| 6,132,031 | A | 10/2000 | Watanabe | 347/58 |
| 6,137,510 | A | 10/2000 | Sato et al. | 347/63 |
| 6,341,845 | B1 | 1/2002 | Scheffelin et al. | |
| 6,896,359 | B1 | 5/2005 | Miyazaki et al. | 347/58 |
| 6,910,759 | B2 | 6/2005 | Kawamura et al. | 347/50 |
| 7,533,960 | B2 * | 5/2009 | Yasuda et al. | 347/40 |
| 7,547,094 | B2 * | 6/2009 | Kawamura et al. | 347/50 |
| 2007/0139469 | A1 | 6/2007 | Yasuda et al. | 347/42 |

FOREIGN PATENT DOCUMENTS

| | | |
|---|---|---|
| JP | 2001-171122 | 6/2001 |
| JP | 2002-331666 | 11/2002 |

* cited by examiner

INK JET RECORDING HEAD AND RECORDING APPARATUS

TECHNICAL FILED

The present invention relates to a recording head adapted to a recording device that discharges a recording liquid such as ink and that performs a recording operation. More specifically, the present invention relates to connection between a liquid discharge substrate adapted to this recording head and a wiring member.

BACKGROUND ART

Generally, an ink jet recording head employed in an ink jet recording apparatus includes an ink jet recording head for forming a droplet of ink or the like and a supply system that supplies the ink or the like to this recording head.

As for connection between a liquid discharge substrate adapted to this recording head and a wiring member, a wide array ink jet device configured by a print head substrate having electric connection electrodes formed on an opposite surface to a surface on which a discharge port is formed is disclosed in Japanese Patent Application Laid-Open No. 11-192705. FIGS. 17 and 18 show a wide array ink jet pen 210 described in Japanese Patent Application Laid-Open No. 11-192705. FIG. 17 is a perspective view of the wide array ink jet pen including a wide array print head. FIG. 18 is a partial sectional view of print head dies and a support substrate 220 for showing an electric connection portion of the wide array ink jet print head shown in FIG. 17. The pen 210 includes a wide array print head 212 and a pen main body 214. The pen main body 214 is a housing to which the print head 212 is attached. The pen main body 214 includes an internal chamber 216 that acts as a local ink tank. Referring to FIGS. 17 and 18, the print head 212 includes a plurality of print heads 218 attached onto the support substrate 220. An electrode 284 for electrical connection and an ink supply port 242 are formed on a back surface of each print head 218 opposite to a surface on which a nozzle opening 238 is formed. Electric wirings are formed on a first surface 270 and a second surface 272 of the support head 220 for holding the print heads 218, respectively. The support substrate 220 is arranged to be electrically connected to the print heads 218 by solder bumps on the first surface 270 thereof, respectively. A logic circuit (not shown) and a driver circuit 230 are mounted on the second surface 217 of the substrate 220 opposite to the first surface 270.

The ink jet recording head configured so that the liquid discharge substrates include the ink supply ports formed on the back surfaces thereof opposite to the surfaces on which the nozzle openings are formed, includes connection electrodes for the electrical connection to the other members provided near the nozzle openings, and are electrically connected to the surface of the support substrate on which the electrical wiring is formed as stated above has the following disadvantages.

For example, in the ink jet recording head shown in FIG. 18, the ink supply port formed in the support substrate and that formed in the liquid discharge substrate should communicate with each other. Specifically, it is necessary to form a partition wall that ensures separating the liquid, around the ink supply ports to thereby completely prevent entry of the ink into the electrical connection portion and to also completely prevent leakage of the ink to the outside.

To do so, it is important to ensure high opening dimension accuracy and high position accuracy of the ink supply ports of the liquid discharge substrate and the support substrate.

In the head disclosed in the Japanese Patent Application Laid-Open No. 11-192705, the support substrate 220 is formed out of such a plate member including silicon, multilayer ceramic, or glass epoxy resin and having a substantial thickness as that used when forming a hybrid multi-chip module.

The support substrate 220 is, therefore, inferior in workability and the opening position accuracy and the opening dimension accuracy of the ink supply port 242 are not so high. As a result, the ink supply port of the support substrate 220 tends to be relatively misaligned to the ink supply port of the liquid discharge substrate. This disadvantage is conspicuous particularly if an adhesive or a sealing agent is used in the liquid partition wall of each ink supply port. With this configuration, the position of the adhesive and the sealing agent is greatly influenced by that of an end surface of the ink supply port of the support substrate. As a result, if the position of the end surface of the ink supply port of the support substrate overlaps with that of the ink supply port of the liquid discharge substrate, the adhesive or sealing agent disadvantageously flows into the ink supply port of the liquid discharge substrate. Besides, in the ink jet head, a desire to arrange a plurality of liquid discharge substrates as narrow as possible at high density from viewpoints of cost and size rises. Accordingly, it is also necessary to form the ink supply port of the support substrate as narrow as possible at high density. However, the support substrate disclosed in FIG. 18 has sufficiently large thickness, with the result it is difficult to form the narrow ink supply port with high accuracy.

SUMMARY OF THE INVENTION

It is an object of the present invention to provide a highly reliable ink jet recording head capable of solving the above-stated disadvantages and to provide an ink jet recording apparatus that employs the recording head.

It is another object of the present invention to provide an ink jet recording head configured so that a side surface of the liquid supply port of an electrical wiring member is covered with a sealing agent, whereby it is possible to suppress ink that is a recording liquid from entering a wiring formed on the electrical wiring member and present on the side surface of the liquid supply port thereof and to suppress elution from being generated in the ink. In addition, it is another object of the present invention to provide an ink jet recording apparatus that employs the recording head.

It is yet another object of the present invention to provide an ink jet recording head that can seal an electrical connection portion by filling up a sealing agent between a liquid discharge substrate and an electrical wiring member, and that can prevent the sealing agent from flowing into a liquid supply port of the liquid discharge substrate when a liquid partition wall which prevents the liquid from leaking to surroundings of the liquid supply port. In addition, it is yet another object of the present invention to provide an ink jet recording apparatus that employs the recording head.

It is still another object of the present invention to provide an ink jet recording head comprising: a liquid discharge substrate that includes a discharge port for discharging a liquid to a surface of the liquid discharge substrate, a liquid supply port for supplying the liquid discharged from the discharge port to a back surface of the liquid discharge substrate, and an electrode for transmitting and receiving a signal for driving energy generating means for discharging the liquid from the discharge port; a film-like electrical wiring member that is joined with the back surface of the liquid discharge substrate, and that includes a liquid supply port communicating with the liquid supply port of the liquid discharge substrate and an electrical connection portion connected to the electrode; and a holding member that holds the liquid discharge substrate through the electrical wiring member, and that includes a liquid supply port for supplying the liquid to the liquid supply port of the liquid discharge substrate, wherein the liquid supply port of the electrical wiring member, the liquid supply port of the liquid discharge substrate, and the liquid supply port of the holding member communicate with one another, a sealing agent for sealing the electrical connection portion is filled up between the liquid discharge substrate and the electrical wiring member, and a side surface of the liquid supply port of the electrical wiring member is covered with the sealing agent. In addition, it is still another object of the present invention to provide an ink jet recording apparatus that employs the recording head.

BRIEF DESCRIPTION OF THE DRAWINGS

FIGS. 8A and 8B show a second embodiment of the present invention, wherein FIG. 8A is a typical view that shows a section taken along 5-5 of FIG. 1 and FIG. 8B is a typical view that shows a section taken along 6-6 of FIG. 1;

BEST MODE FOR CARRYING TO THE INVENTION

Embodiments

Embodiments of the present invention will be described hereinafter with reference to the drawings.

First Embodiment

Figure 1:
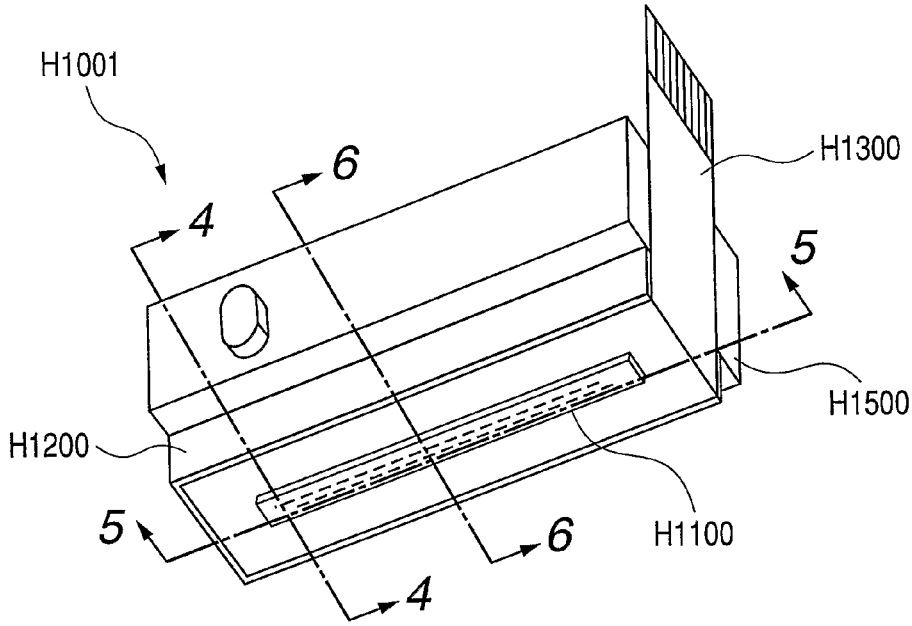
FIG. 1 is an external perspective view that shows an overall ink jet recording head according to a first embodiment of the present invention.
Figure 2:
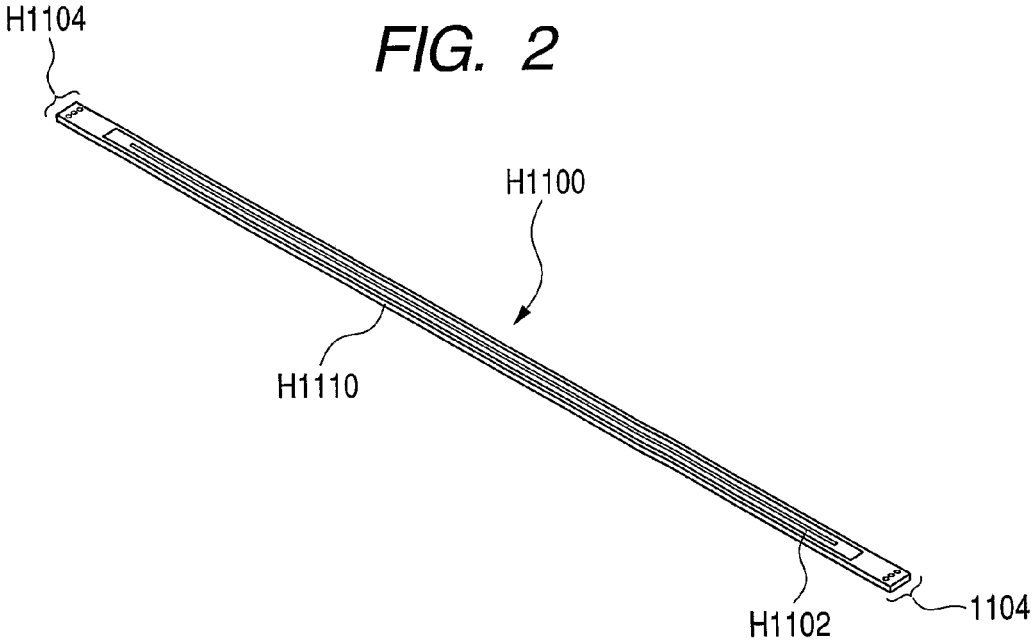
FIG. 2 is a schematic perspective view of a liquid discharge substrate used in the ink jet recording head shown in FIG. 1.
Figure 3:
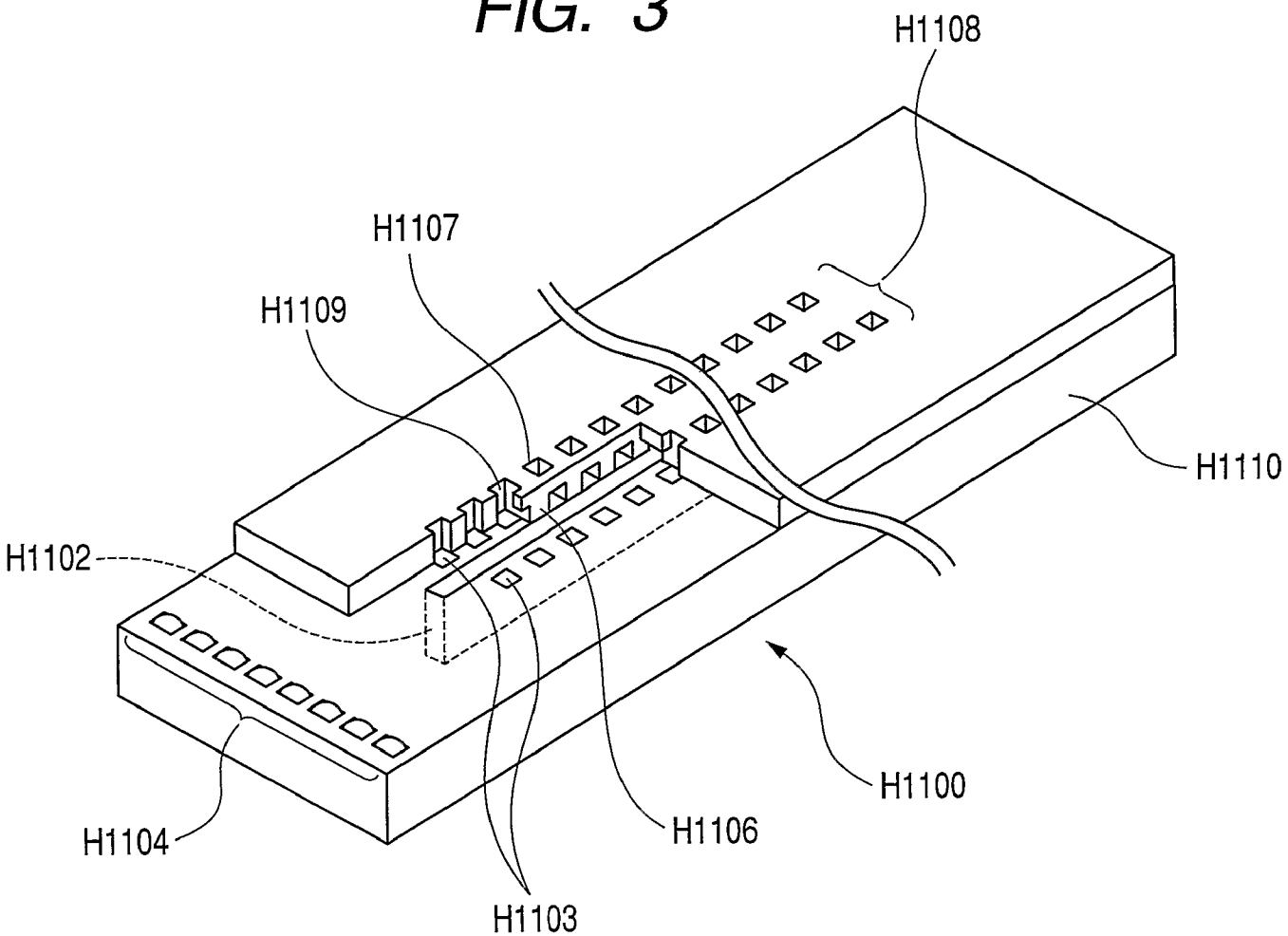
FIG. 3 is an enlarged, partial perspective view of the ink jet recording head shown in FIG. 2.

FIG. 1 is an external perspective view that shows an overall ink jet recording head according to a first embodiment of the present invention. FIG. 2 is a schematic perspective view of a liquid discharge substrate used in the ink jet recording head shown in FIG. 1. FIG. 3 is a partial, enlarged perspective view of the ink jet recording head shown in FIG. 2.

Figure 4:
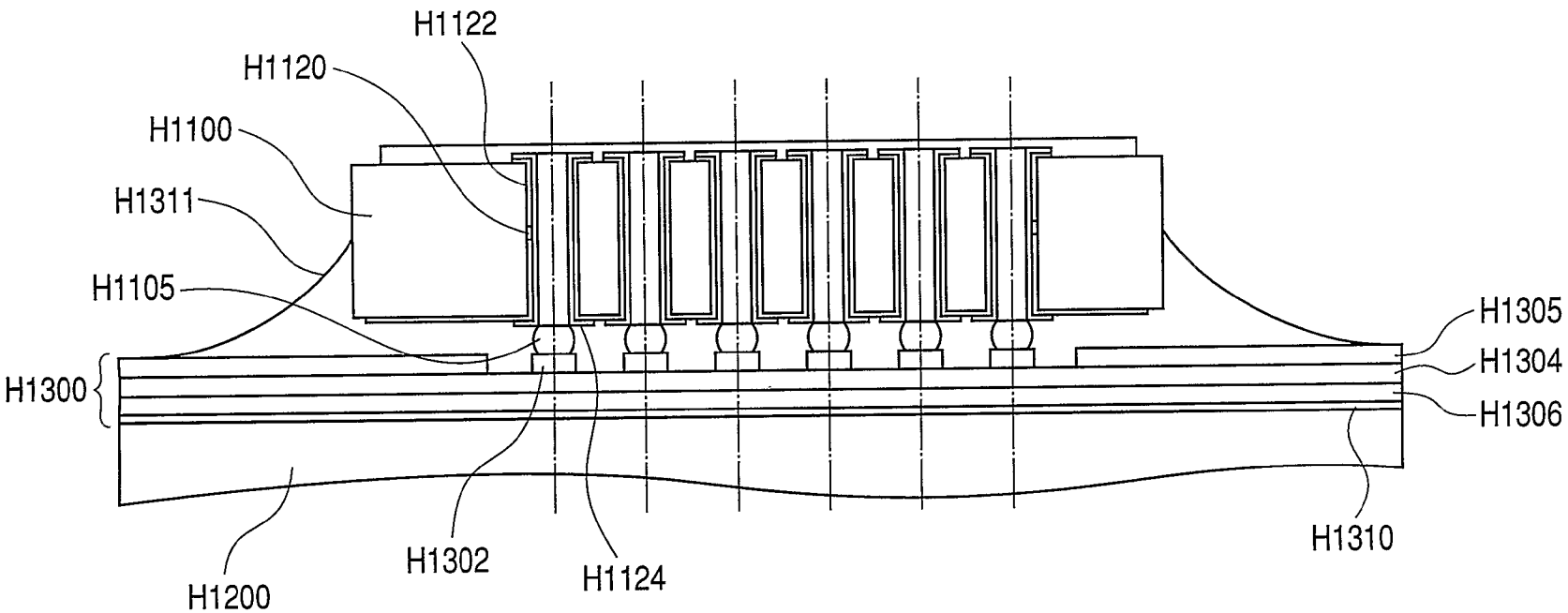
FIG. 4 is a typical view that shows a section taken along 4-4 of FIG. 1 and that is a sectional view near an electrode.
Figure 5:
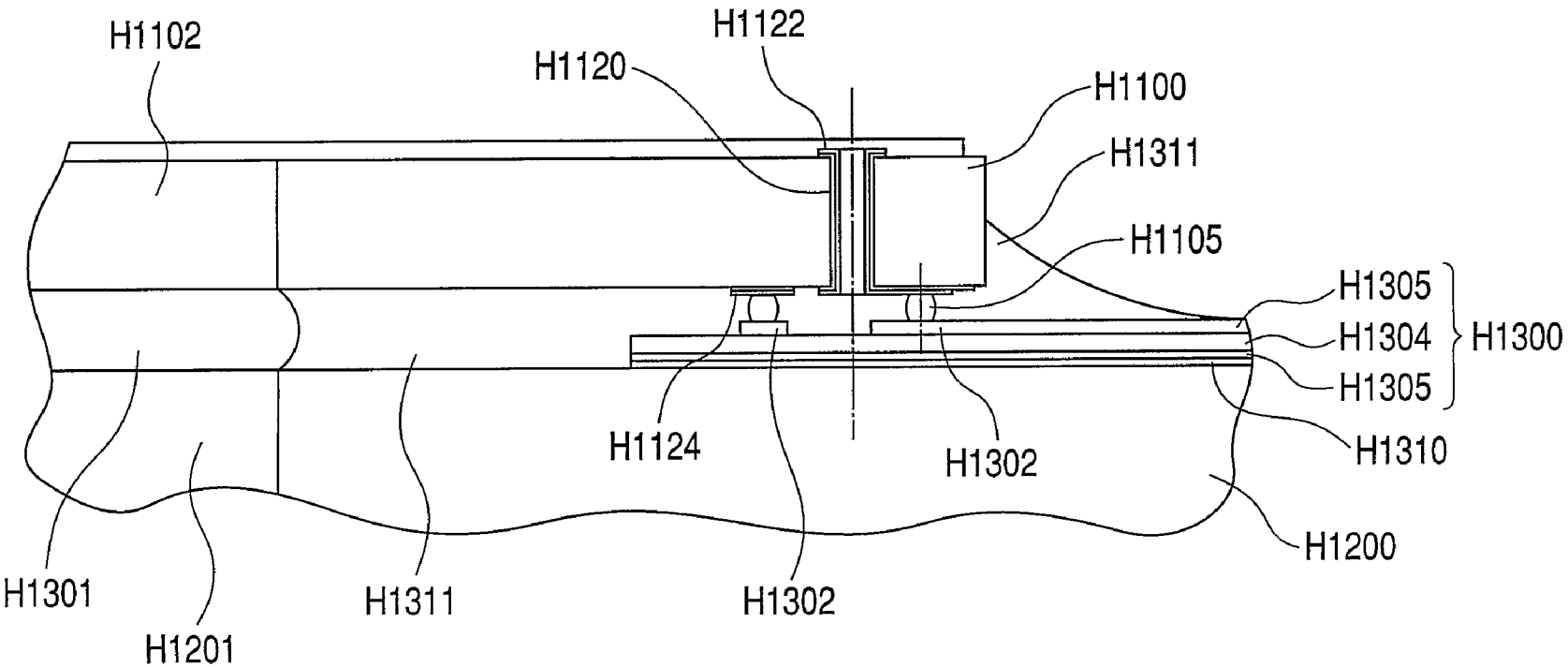
FIG. 5 is a typical view that shows a section taken along 5-5 of FIG. 1.
Figure 6:
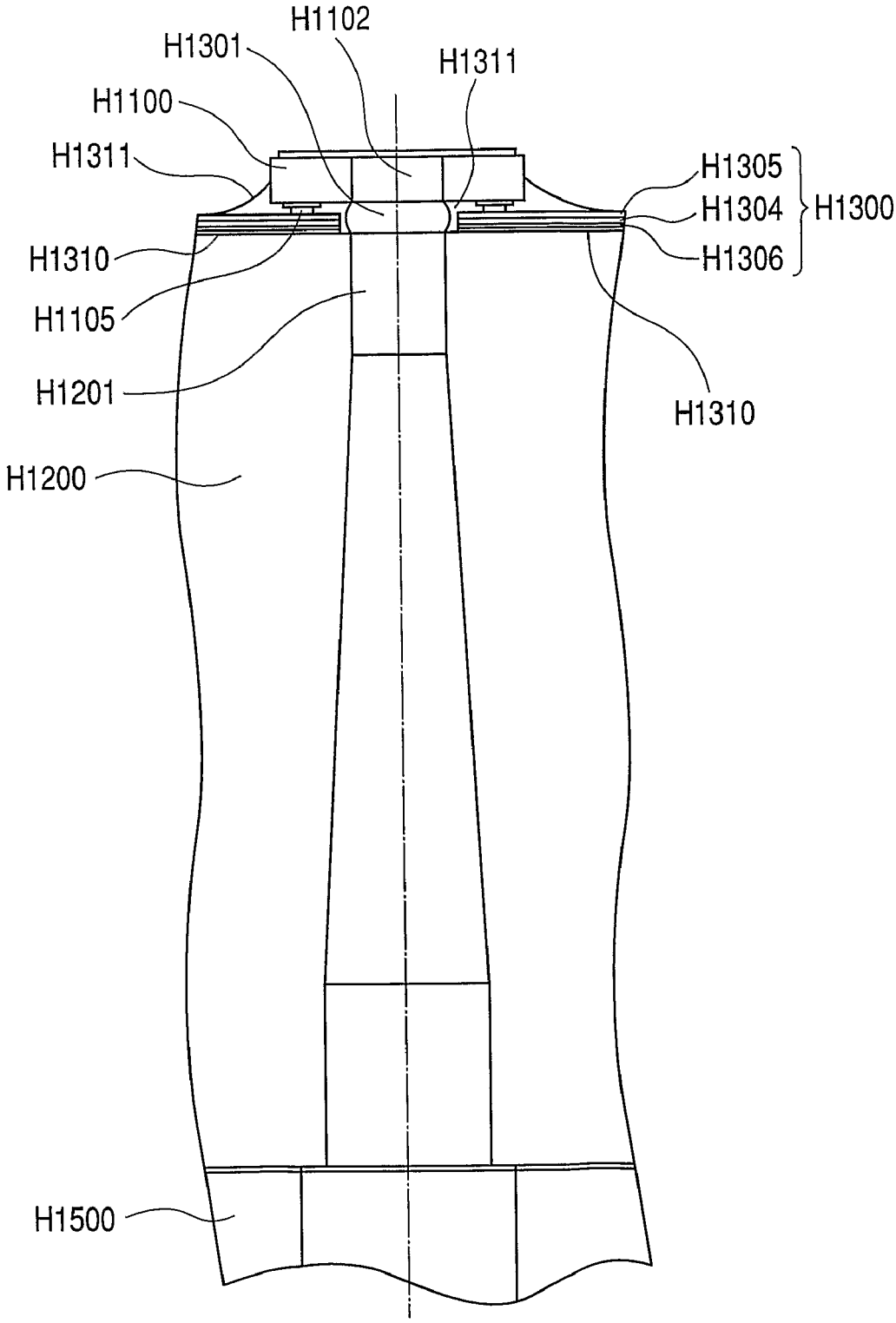
FIG. 6 is a typical view that shows a section taken along 6-6 of FIG. 1.

FIG. 4 is a typical view that shows a section taken along 4-4 of FIG. 1 and that is a sectional view near an electrode. FIG. 5 is a typical view that shows a section taken along 5-5 of FIG. 1. FIG. 6 is a typical view that shows a section taken along 6-6 of FIG. 1.

A recording head H1001 shown in FIG. 1 is fixedly supported by positioning means of a carriage (not shown) mounted on an ink jet recording apparatus main body and an electrical contact. An ink tank (not shown) is detachable to the recording head H1001. Since the ink tank is replaceable, running cost for recording by an ink jet recording apparatus is reduced.

As shown in FIGS. 2 and 3, discharge ports 1107 for discharging a recording liquid (e.g., ink) are formed in a liquid discharge substrate H1100 of the recording head H1001, and a discharge port row H1108 is formed by a plurality of rows of discharge ports 1107. A liquid supply port H1102 for supplying the recording liquid is formed on a back surface of the liquid discharge substrate row H1108 to be substantially as long as the discharge substrate row H1108. The recording liquid from the liquid supply port H1102 is foamed by an electric-to-thermal converter element H1103 such as a heater provided in a foaming chamber H1109, and discharged from the discharge ports H1107. A plurality of electrodes H1104 for transmitting an electric signal is formed on each end of the liquid discharge substrate H1100. As shown in FIG. 4, penetrating wirings H1122 penetrating the liquid discharge substrate H1100 are provided to extend from the electrodes H1104 so as to be connected to back surface electrodes H1124 formed on the back surface of the liquid discharge substrate H1100, respectively.

As shown in FIGS. 4 and 5, the electrodes and the like for transmitting the electric signal are formed on each end of the liquid discharge substrate H1100. Through holes H1120 formed by a laser, etching or the like are formed in the liquid discharge substrate H1100, and the penetrating wirings H1122 for connecting the electrical wiring on the surface of the liquid discharge substrate H1100 to the back surface electrode H1124 are formed in the respective through holes H1120.

A film-like wiring member, which is a flexible wiring substrate H1300 in this embodiment, is arranged below the liquid discharge substrate H1100. The flexible wiring substrate H1300 is configured so that a first wiring layer H1305 and a second wiring layer H1306 are formed on both surfaces of a film-like base film H1304 of a polyimide resin or the like, respectively. Each wiring layer includes a wiring obtained by patterning a Cu foil or the like.

A bump H1105 is formed on each electrode terminal H1302 formed by the first wiring layer H1305 on an upper surface of the flexible wiring substrate H1300. Further, the bump H1105 is joined with each back surface electrode H1124 of the liquid discharge substrate H1100, whereby an electrical connection is held therebetween, and electric power and the electrical signal necessary when discharging the recording liquid are supplied from the flexible wiring substrate H1300 to the liquid discharge substrate H1100. The electrical connection portion is sealed by a sealing agent (or adhesive) H1311, so that the electrical connection portion is protected from corrosion, impact, and the like caused by the recording liquid.

A holding member H1200 is provided under the flexible wiring substrate H1300, and the holding member H1200 is joined with the flexible wiring substrate H1300 by an adhesive H1310.

As shown in FIG. 6, liquid supply ports 1201 and 1301 are formed in the holding member H1200 and the flexible wiring substrate H1300, respectively. The liquid supply port 1201 of the holding substrate H1200, the liquid supply port H1301 of the flexible wiring substrate H1300, and the liquid supply port H1102 of the liquid discharge substrate H1100 are arranged to communicate with each other by making center lines of the ports coincident with one another. By so arranging, the recording liquid supplied from a liquid supply member H1500 is supplied to the liquid discharge substrate H1100. While the bump H1105 shown in FIG. 6 may be employed to transmit the electrical signal, it may be employed for heat radiation of releasing heat generated by the liquid discharge substrate H1100 due to discharge to the holding member H1200 through the flexible wiring substrate H1300.

The electrical connection portion formed by the bump H1105 and the like and a side surface of the liquid supply port H1301 of the flexible wiring substrate H1300 are sealed by the sealing agent (or adhesive) H1311, thereby completely isolating the electrical connection portion and the side surface of the liquid supply port H1201 from the recording liquid from the liquid supply port H1201. In addition, surroundings of the liquid supply port H1102 of the liquid discharge substrate H1100 are completely sealed by the sealing agent H1311, so that the liquid discharge substrate H1100 is isolated from the outside and unnecessary leakage of the recording liquid to the outside is thereby prevented.

Figure 7A:
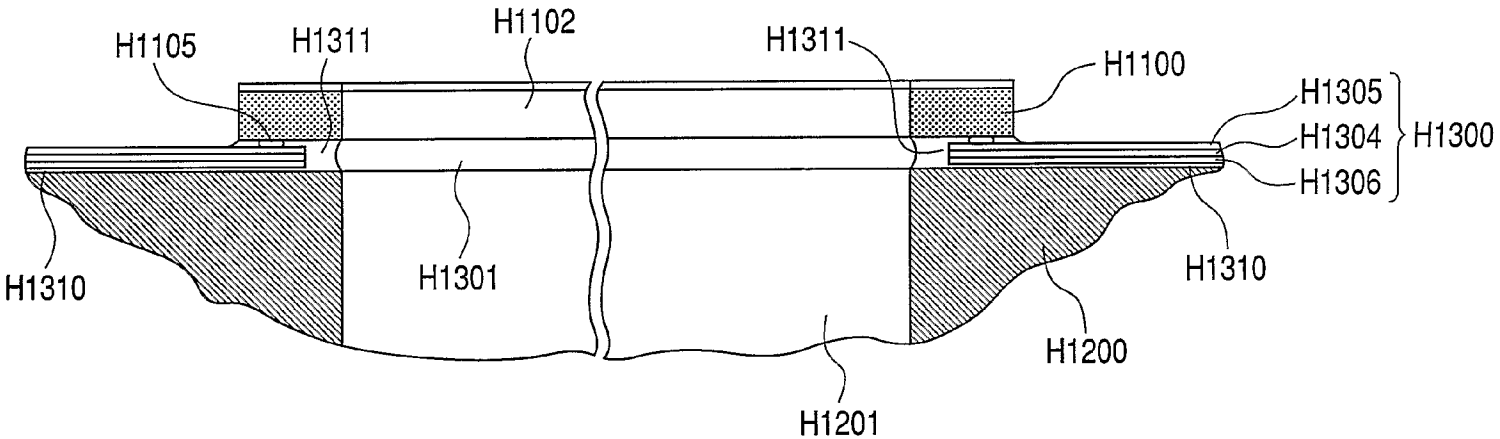
FIG. 7A is a typical view that shows a section taken along 5-5 of FIG. 1
Figure 7B:
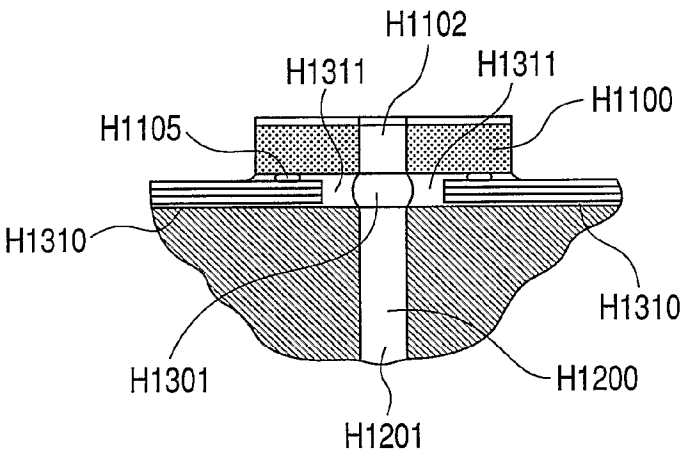
FIG. 7B is a typical view that shows a section taken along 6-6 of FIG. 1.

In this embodiment, the liquid supply port H1301 of the flexible wiring substrate H1300 that is the film-like electrical wiring member is formed to be larger in size than the ink supply port H1102 of the liquid discharge substrate H1100 and the liquid supply port H1201 of the holding member H1200, as shown in FIGS. 7A and 7B.

The liquid supply port H1301 of this flexible wiring substrate H1300 can be formed while ensuring high accuracy of an opening dimension and an opening position since the flexible wiring substrate H1300 is thin. As a result, high relative position accuracy can be ensured when the liquid supply port H1301 is arranged relatively to the liquid supply port H1102 of the liquid discharge substrate H1100 and to the liquid supply port H1201 of the holding member H1200.

Furthermore, by filling up the adhesive or sealing agent H1311 between the liquid discharge substrate H1100 and the flexible wiring substrate H1300, it is possible to ensure sealing of the electrical connection portion and to prevent entry of the liquid (ink) from the liquid supply ports. In this case, the adhesive or sealing agent H1311 is applied between the liquid discharge substrate H1100 and the flexible wiring substrate H1300 so as to completely cover an opening end surface that forms the liquid supply port H1310 of the flexible wiring substrate H1300, thereby preventing the liquid supply port H1301-side wiring layers H1305 and H1306 of the flexible wiring substrate H1300 from being exposed to the liquid (ink). With this configuration, the wiring layers exposed to the side surface of the liquid supply port 1301 of the flexible wiring substrate H1300 are sealed by the adhesive or sealing agent, thereby making it possible to prevent the wirings from being corroded by the liquid. Accordingly, problems that a constituent matter of the wiring is eluted to the ink, that this elution causes deterioration in a recording quality, and that eventually recording operation cannot be performed do not occur.

Further, with the configuration shown in FIGS. 7A and 7B, not only the adhesive or sealing agent H1311 applied and filled up between the liquid discharge substrate H1100 and the flexible wiring substrate H1300 is protruded to an inside of the liquid supply port H1301 of the flexible wiring substrate H1300 but also the adhesive H1310 for joining the flexible wiring substrate H1300 with the holding member H1200 is protruded toward the ink supply ports. It is thereby possible to seal the side surface of the liquid supply port H1301 of the flexible wiring substrate H1300.

In this case, the adhesive applied and filled up between the liquid discharge substrate H1100 and the flexible wiring substrate H1300 may differ from that for joining the flexible wiring substrate H1300 with the holding member H1200. It is, however, preferable that the both adhesives are joined together.

The application and filling of the adhesive or sealing agent may be performed either before or after the electrical connection between the liquid discharge substrate H1100 and the flexible wiring substrate H1300 in all the configurations stated so far.

In this embodiment, the connection of the back surface electrode H1124 of the liquid discharge substrate H1100 to each electrode terminal H1302 of the flexible wiring substrate H1300 is held by a metal bump such as a gold bump. Alternatively, a method for connecting the electrodes using a conductive adhesive or press-contacting the electrodes using a thermosetting adhesive may be used. In addition, the thermosetting adhesive may contain electrically conductive particles.

In this embodiment, one liquid discharge substrate is mounted per recording head and the number of discharge port rows of the liquid discharge substrate is one. For this reason, one recording head can perform only monochromatic recording. However, by using a plurality of recording heads, multicolor recording can be performed.

With the above-stated configuration, therefore, the back surface electrode of the liquid discharge substrate is electrically connected to each electrode terminal of the flexible wiring substrate, and the surroundings of the liquid supply port of the liquid discharge substrate are sealed, thereby preventing the sealing agent from being protruded to the surface of the liquid discharge substrate. Thanks to this, the distance between the recording head and a recording medium can be determined according to a distance from the surface of the liquid discharge substrate to the recording medium, and the distance can be made smaller than that according to the conventional technique. This enables improving impact accuracy for causing a discharged recording droplet to adhere onto the recording medium and eventually enables high-quality recording. Further, when ink contamination on an orifice surface is removed by rubbing using a rubber blade, the recording head does not obstruct cleaning of the orifice surface using the rubber blade. Besides, the compact recording head can be constituted.

Moreover, a relatively inexpensive flexible wiring substrate can be employed as the electrical wiring member. As compared with the conventional technique, the recording head can be manufactured without using a relatively expansive member such as silicon or multilayer ceramic used to form the hybrid multi-chip module. The inexpensive recording head can be, therefore, constituted.

Second Embodiment

A second embodiment of the present invention will be described. In this embodiment, differences of the second embodiment from the first embodiment will be mainly described.

Figure 8A:
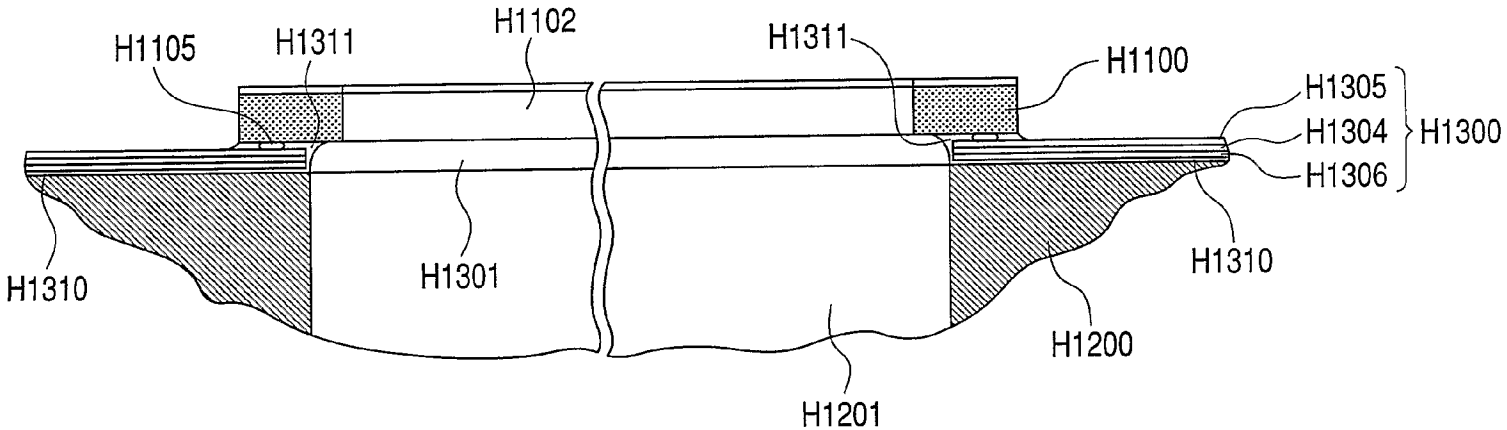
Figure 8B:
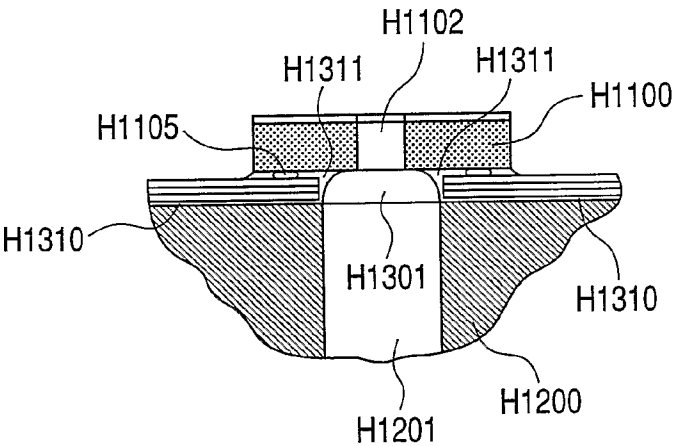

FIGS. 8A and 8B show the second embodiment of the present invention. FIG. 8A is a typical view that shows a section taken along 5-5 of FIG. 1 and FIG. 8B is a typical view that shows a section taken along 6-6 of FIG. 1.

In this embodiment, the liquid supply port H1301 of the flexible wiring substrate H1300 is formed to be larger than the liquid supply port H1102 of the liquid discharge substrate H1100 and to be substantially equal in size to the liquid supply port 1201 of the holding member H1200.

The side surface of the liquid supply port H1301 of the flexible wiring substrate H1300 is completely sealed by the adhesive or sealing agent.

For instance, the adhesive or sealing agent filled up between the liquid discharge substrate H1100 and the flexible wiring substrate H1300 is sufficiently applied therebetween and protruded to the inside of the liquid supply port H1301 of the flexible wiring substrate H1300. It is thereby possible to cover the side surface of the liquid supply port H1301 of the flexible wiring substrate H1300 with the adhesive or sealing agent. In this case, the application and filling of the adhesive or sealing agent may be either before or after the electrical connection between the liquid discharge substrate H1100 and the flexible wiring substrate H1300.

In order to ensure the electrical connection between the back surface electrode H1124 of the liquid discharge substrate H1100 and each electrode H1302 of the flexible wiring substrate H1300, it is necessary to bond the flexible wiring substrate H1300 to the holding member H1200 with high flatness and uniformly using the adhesive so as not to generate bubbles or the like on lower surfaces of electrode portions. It is necessary to bond them particularly while surely protruding the adhesive into the lower surface of the electrical connection portion near the liquid supply port H1301 of the flexible wiring substrate H1300. The adhesive may possibly be protruded toward the liquid supply port H1201 of the holding member H1200. In this embodiment, this protruded adhesive may be used to cover the side surface of the liquid supply port H1301 of the flexible wiring substrate H1300.

Accordingly, the side surface of the liquid supply port H1301 of the flexible wiring member H1300 can be completely covered with the adhesive or sealing agent without need of a new step and use of a new material. In addition, flexibility of selection of the flexible wiring member H1300 can be enhanced without direct contact of the wiring material of the flexible wiring member with the liquid (ink) in the liquid supply port.

With this configuration, therefore, the recording head that has high reliability in respect of electrical connection and ink supply and that is inexpensive can be provided.

Third Embodiment

A third embodiment of the present invention will be described. In this embodiment, differences of the third embodiment from the first embodiment will be mainly described.

Figure 9:
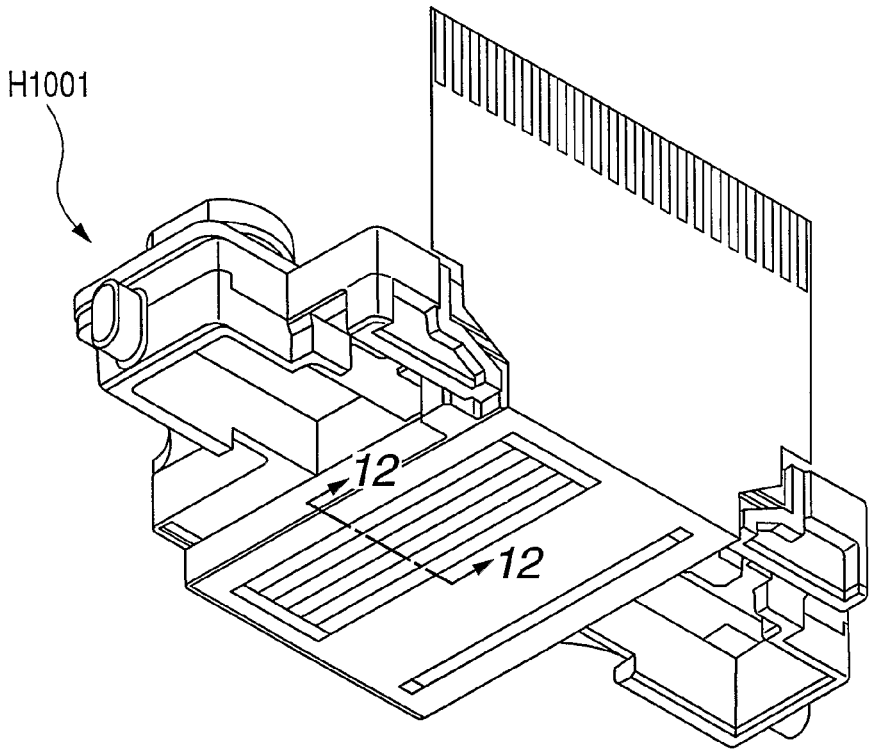
FIG. 9 is a schematic perspective view that shows an overall ink jet recording head according to a third embodiment of the present invention, from a front surface side of a liquid discharge substrate.
Figure 10:
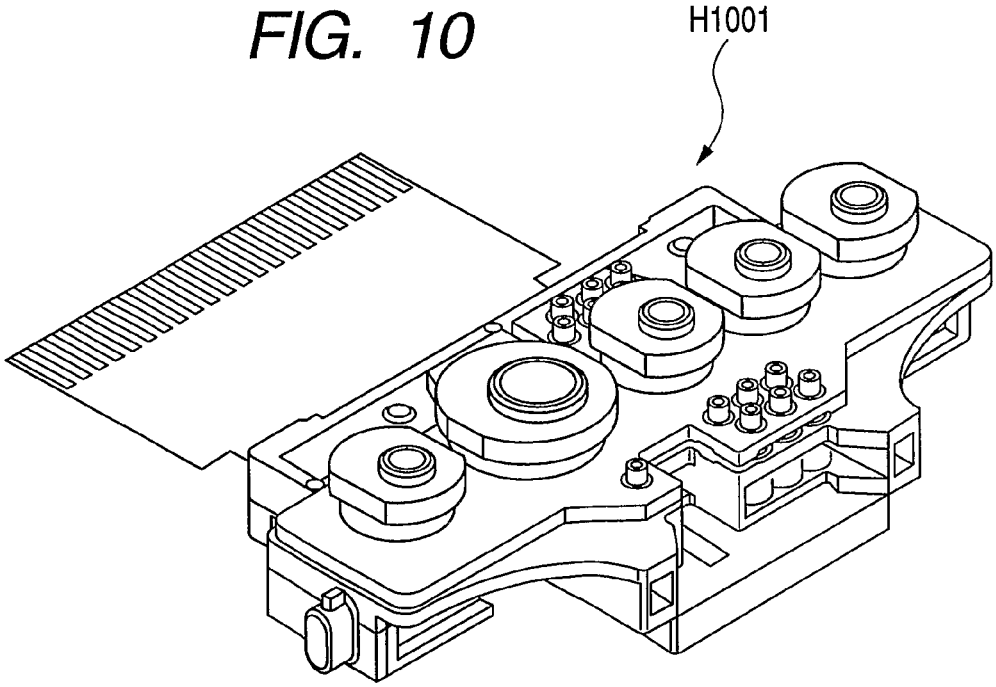
FIG. 10 is a perspective view that shows the recording head shown in FIG. 9, from a rear surface side of the liquid discharge substrate.
Figure 11:
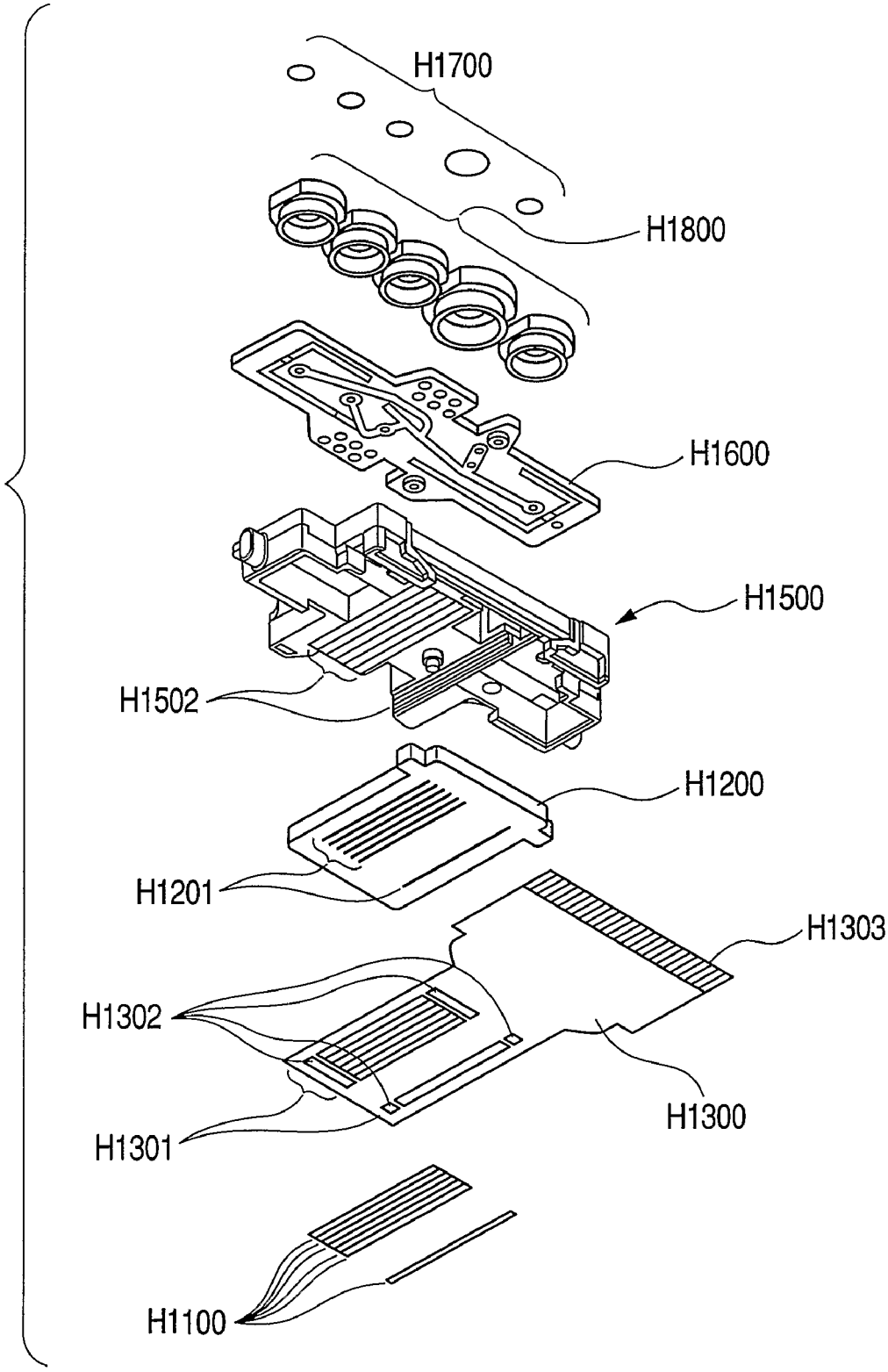
FIG. 11 is an exploded perspective view of an ink jet recording head according to the second embodiment of the present invention.
Figure 12:
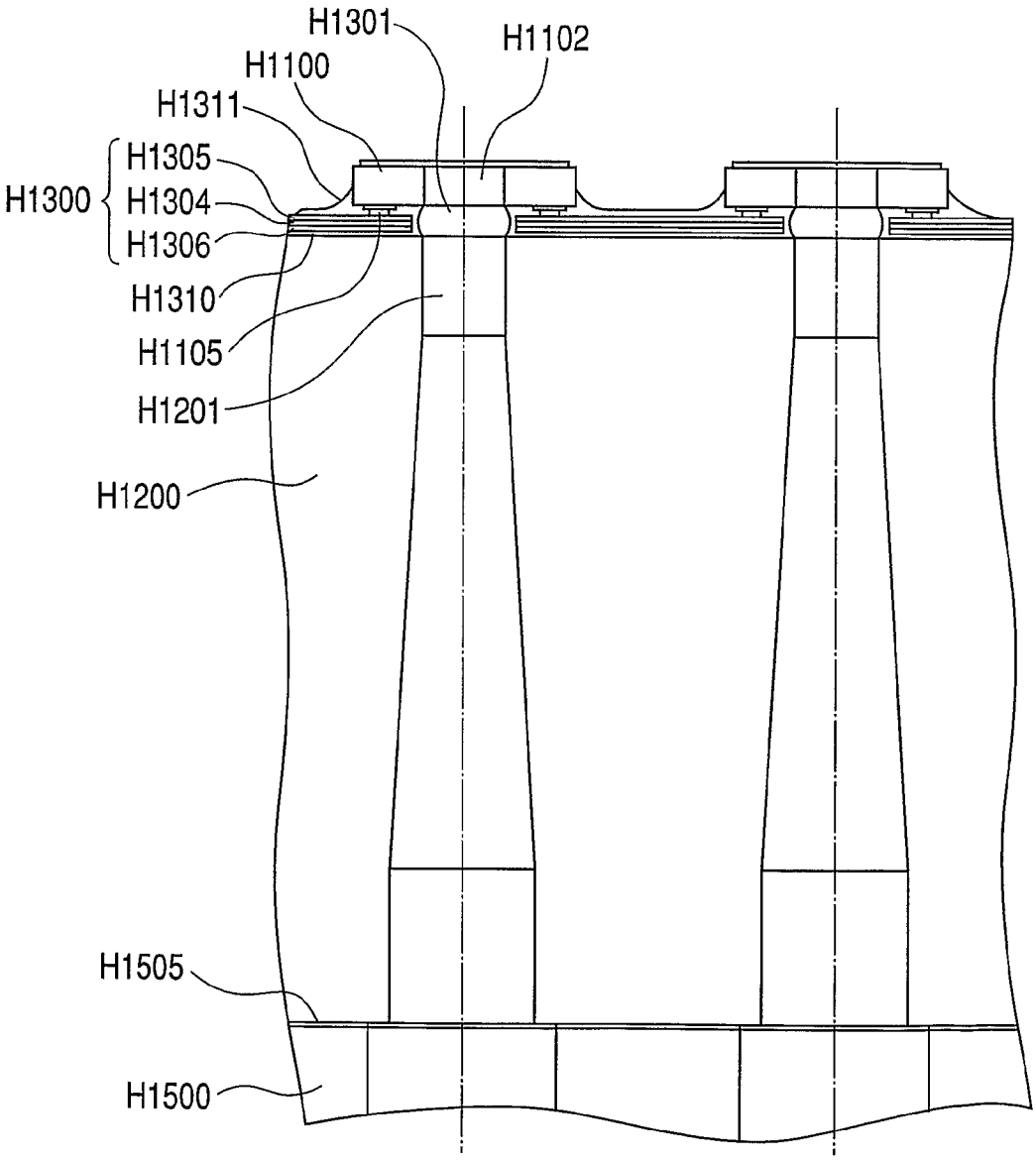
FIG. 12 is a typical view that shows a section taken along 12-12 of FIG. 9.

FIG. 9 is a perspective view that shows an entire ink jet recording head according to the third embodiment of the present invention, from a surface side of a liquid discharge substrate. FIG. 10 is a perspective view that shows the recording head from a rear surface side thereof. FIG. 11 is an exploded perspective view of the ink jet recording head according to the third embodiment. FIG. 12 is a typical view that shows a section taken along 12-12 of FIG. 9.

In this embodiment, as compared with the first embodiment, a plurality of liquid discharge substrates are mounted per recording head, so that one recording head can perform multicolor recording. Due to this, the recording head can be formed integrally and compact, component cost can be reduced, and manufacturing cost can be reduced. The inexpensive recording head can be, therefore, constituted.

Similarly to the first embodiment, the recording head H1001 is fixedly supported by the positioning means of the carriage (not shown) mounted on the ink jet recording apparatus main body and the electrical contact. The ink tank (not shown) is detachable to the recording head H1001 and replaceable. However, for the multicolor recording, a plurality of ink tanks are mounted on one recording head. In this embodiment, five ink tanks are mounted thereon.

The recording head H1001 includes components configured as shown in the exploded perspective view of FIG. 11.

The recording head H1001 includes a plurality of liquid discharge substrates H1100, a flexible wiring substrate H1300, a holding member H1200, a first liquid supply member H1500, a second liquid supply member H1600, a seal rubber H1800, and a filter H1700.

The liquid discharge substrate H1100 is equal to that described in the first embodiment with reference to FIGS. 2 and 3. A plurality of liquid discharge substrates H1100 are mounted on the flexible wiring substrate H1300. Liquid supply ports H1301 corresponding to the respective liquid discharge substrates H1100 are formed in the flexible wiring substrate H1300. Likewise, liquid supply ports H1201 corresponding thereto are formed in the holding member H1200. Liquid supply ports H1502 corresponding thereto are also formed in the first liquid supply member H1500 joined with the holding member H1200. By doing so, the liquid supply ports of the respective members are joined together to establish a communication, whereby the recording liquid supplied from the ink tanks (not shown) enters the second liquid supply member H1600 via the filter H1700, enters the liquid supply ports H1502 through a liquid passage H1601, and passes through the liquid supply ports H1201 of the holding member H1200, the liquid supply ports H1301 of the flexible wiring substrate H1300, and the liquid supply ports H1102 of the liquid discharge substrates H1100 in this order. The recording liquid is eventually supplied to a foaming chamber.

An external signal input terminal H1303 is provided on the flexible wiring substrate H1300 to be connected to the carriage (not shown). The external signal input terminal H1301 transmits an electrical signal from an ink jet recording apparatus (not shown) to the liquid discharge substrates H1100.

As shown in the sectional view of FIG. 12, the sectional configuration of the ink jet recording head according to this embodiment is basically equal to that of the ink jet recording head according to the first embodiment. However, because of presence of a plurality of liquid discharge substrates H1100, components are shaped to correspond to the liquid discharge substrates H1100.

The electrical connection portion is similarly sealed by the sealing agent (or adhesive) H1311, thereby completely isolating the electrical connection portion from the recording liquid from the liquid supply ports. In addition, an outer periphery of the liquid supply port H1102 of each liquid discharge substrate H1100 is also completely sealed by the sealing agent H1311, thereby isolating the liquid discharge substrate H1100 from the outside thereof and preventing unnecessary leakage of the recording liquid to the outside. Since leakage between the liquid discharge substrates causes color mixture, it is necessary to seal and bond the liquid discharge substrates with high accuracy.

In this embodiment, it is necessary to mount a plurality of liquid discharge substrates on the single holding member and the single flexible wiring substrate with high positioning accuracy. To ensure high-quality recording, in particular, it is necessary to mount them with high accuracy so as to maintain high relative positioning accuracy for relative arrangement of the adjacent liquid discharge substrates to each other.

In this embodiment, only the liquid discharge substrate for black is arranged separately from the other liquid discharge substrates. This can provide a configuration suited for an instance of using, for example, reaction producing inks (a chemical reaction is provoked between the black and color ink).

With this configuration, besides the advantages of the recording head according to the first embodiment, the recording head which can ensure higher-quality recording, which can be formed compact, and which is inexpensive can be constituted.

Fourth Embodiment

A fourth embodiment will be described. In this embodiment, differences of the fourth embodiment from the first embodiment will be mainly described.

Figure 13:
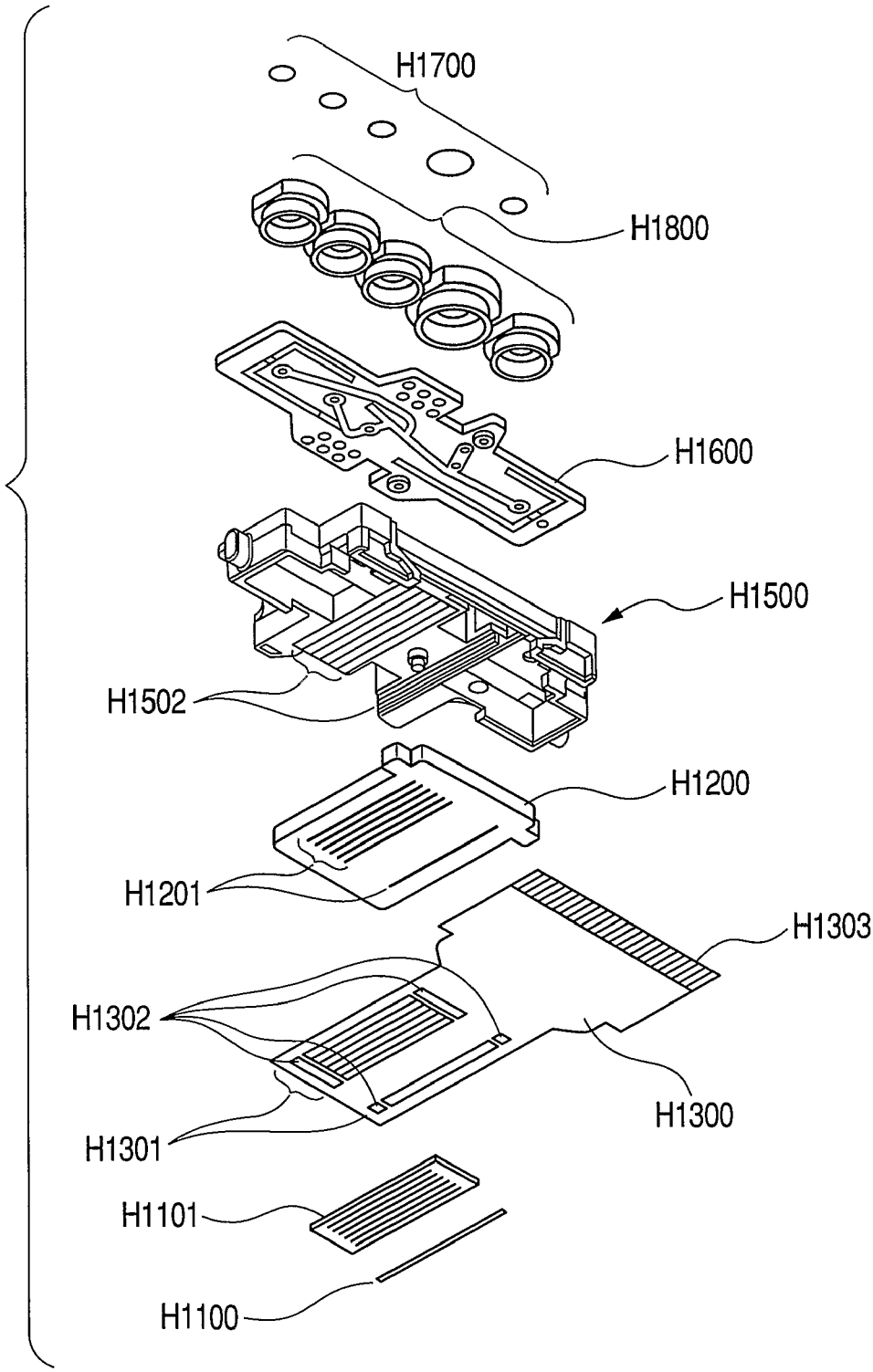
FIG. 13 is an exploded perspective view of an ink jet recording head according to a fourth embodiment of the present invention.
Figure 14:
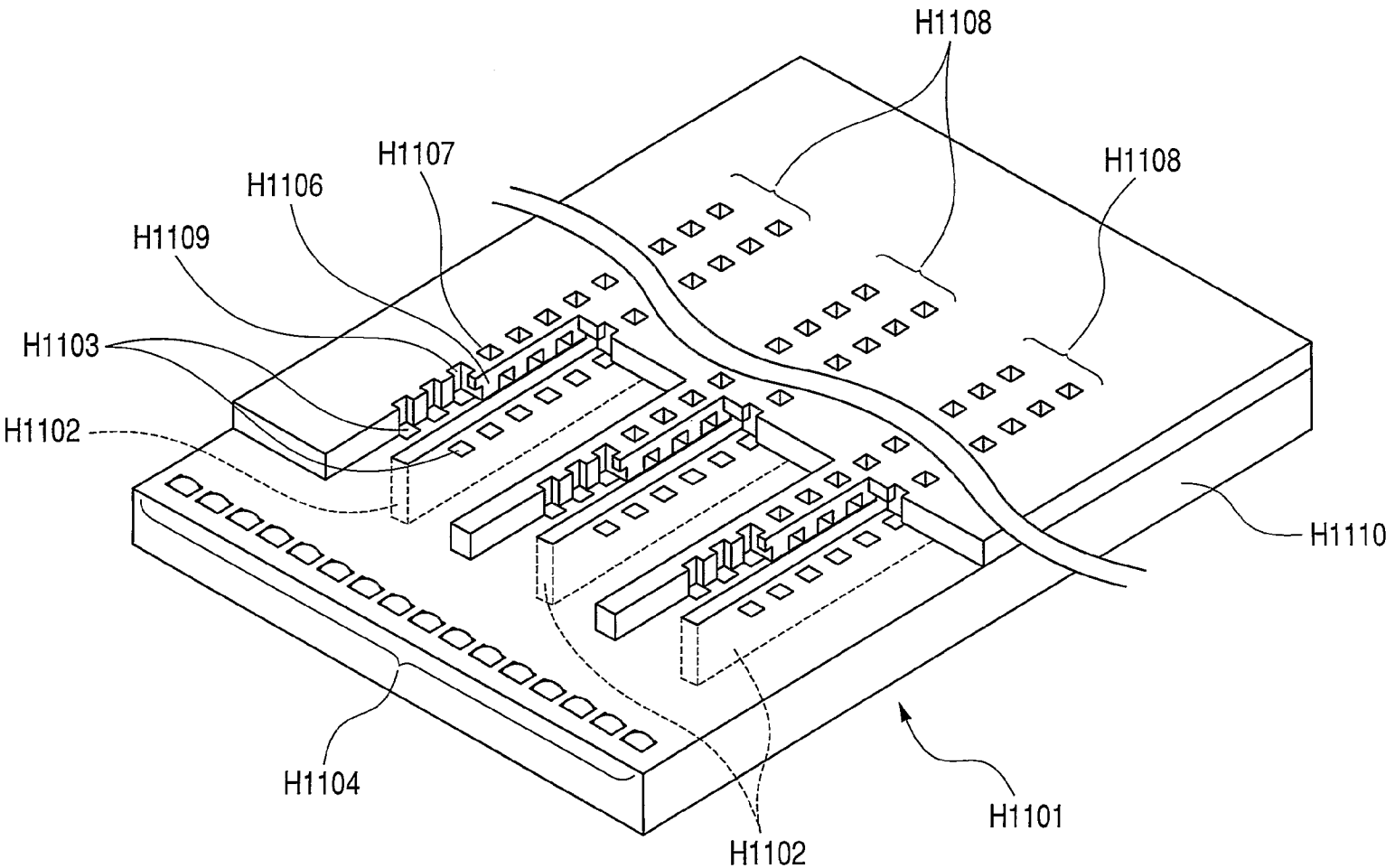
FIG. 14 is a schematic perspective view that shows a part of a liquid discharge substrate used in the ink jet recording head shown in FIG. 13.
Figure 15:
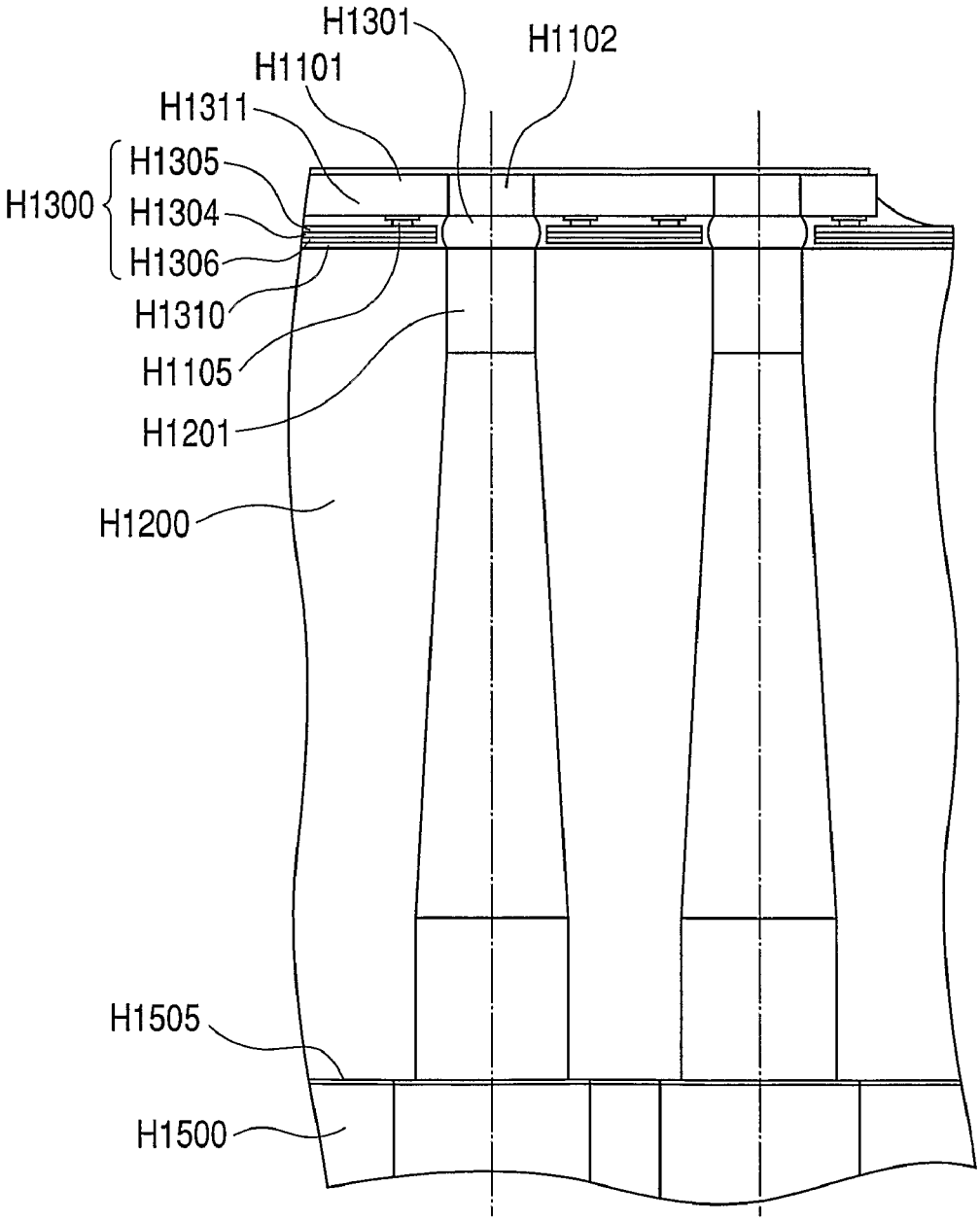
FIG. 15 is a typical view that shows a partial section of the ink jet recording head shown in FIG. 13 near the liquid discharge substrate.

FIG. 13 is an exploded perspective view of an ink jet recording head according to the fourth embodiment of the present invention. FIG. 14 is a schematic perspective view that shows a part of a liquid discharge substrate used in the ink jet recording head shown in FIG. 13. FIG. 15 is a typical view that shows a partial section of the ink jet recording head shown in FIG. 13 near the liquid discharge substrate.

The recording head according to this embodiment is equal in basic configuration to that according to the second embodiment, so that one recording head can perform multicolor recording. This recording head, however, differs in a configuration of the liquid discharge substrate.

As the liquid discharge substrate, the liquid discharge substrate H1100 is used for black similarly to the first and second embodiments. An integral liquid discharge substrate H1101 is used for the other colors.

FIG. 14 shows the integral liquid discharge substrate H1101. In the integral liquid discharge substrate H1101, discharge ports H1107 for discharging the recording liquid (ink) are formed and discharge port rows H1108 are formed by arranging the discharge ports H1107 in rows. Liquid supply ports H1102 for supplying the recording liquid are formed on a back surface of the integral liquid discharge substrate H1101 opposite to a surface on which the discharge port rows H1108 are formed, to be substantially as long as each discharge port row H1108. The liquid supply ports H1102 are formed to be as many as types of the recording liquid. In FIG. 14, three liquid supply ports H1102 and three discharge port rows H1108 are formed to correspond to cyan, magenta, and yellow inks, respectively. By increasing the number of the liquid discharge port rows, the recording head can perform recording using more types of the recording liquid.

The recording liquid entering the foaming chamber H1109 from the liquid supply ports H1102 is foamed by the heat generated by the electric-to-thermal converter element H1103 and discharged from the discharge ports H1107. A plurality of electrodes H1104 for transmitting an electrical signal are formed on each end of the liquid discharge substrate. Penetrating wirings (not shown) penetrating the liquid discharge substrate are provided to extend from the respective electrodes H1104 so as to be connected to the back surface electrodes H1124 formed on the back surface of the liquid discharge substrate, respectively.

A sectional view of the recording head when the integral liquid discharge substrate H1101 is used is shown in FIG. 15.

As stated in this embodiment, by providing the integral liquid discharge substrate for colors other than black, the discharge port rows corresponding to the respective colors are incorporated in one liquid discharge substrate in semiconductor steps. It is, therefore, possible to arrange the discharge port rows corresponding to the respective colors relatively to one another with high accuracy, and perform high-quality recording. In addition, since high accuracy positioning is unnecessary, yield in manufacturing steps can be improved.

Moreover, since wirings can be arranged integrally in the liquid discharge substrate, the number of electrodes can be reduced and the back surface electrodes can be arranged relatively at low density, accordingly. It is, therefore, possible to improve yield in electrical connection steps and eventually constitute an inexpensive recording head.

Fifth Embodiment

Figure 16:
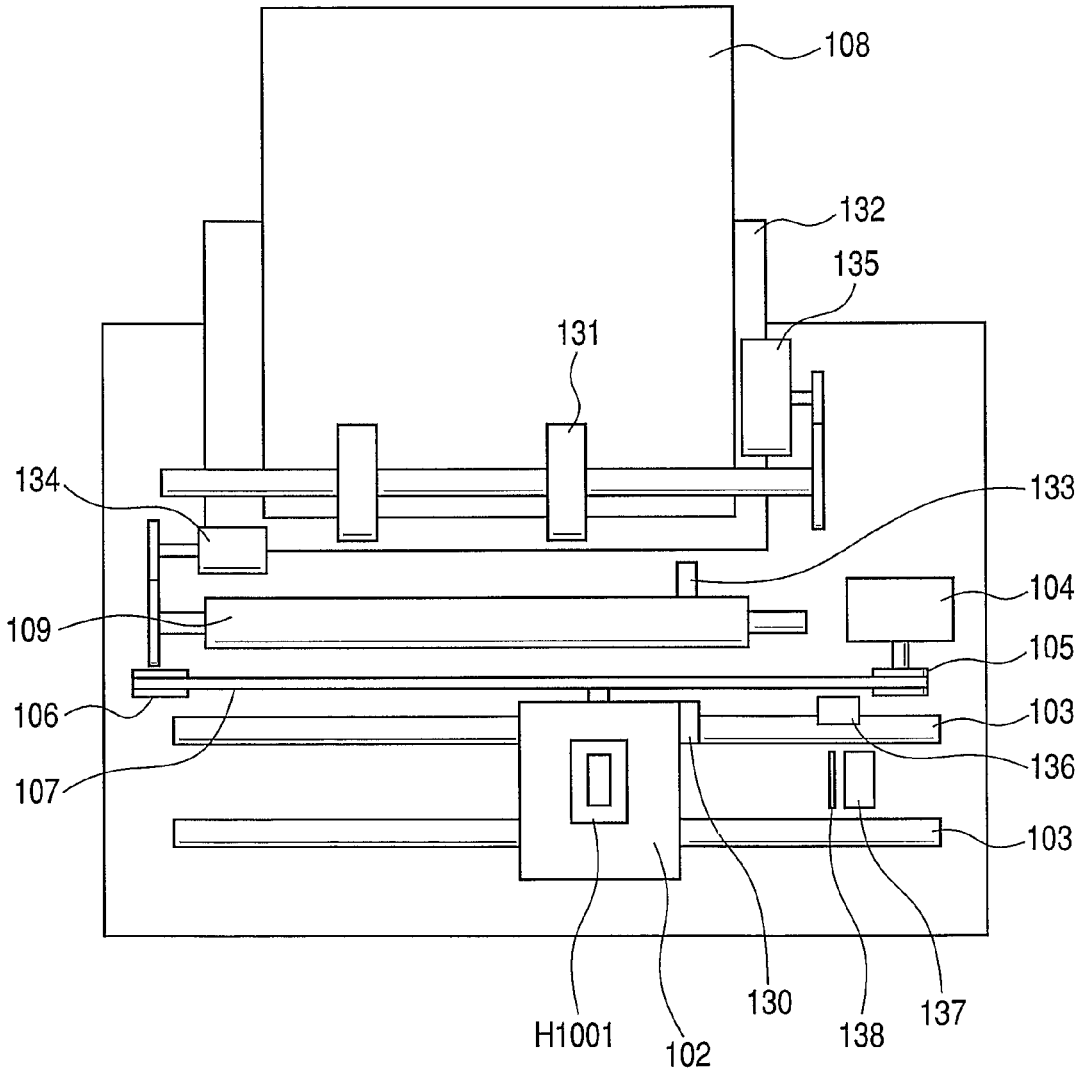
FIG. 16 is an explanatory view that shows one example of a recording device on which the ink jet recording head according to the present invention can be mounted.
Figure 17:
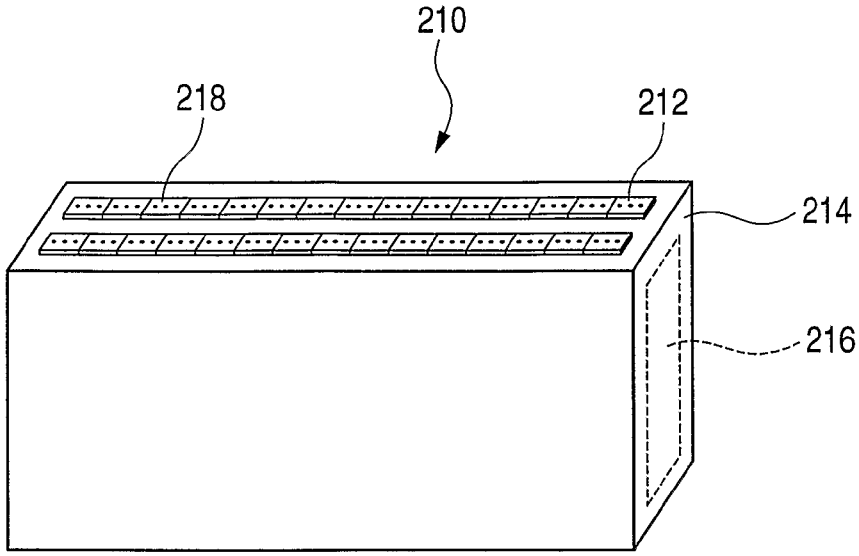
FIG. 17 is a perspective view of a wide array ink jet pen including a print head of the prior art.
Figure 18:
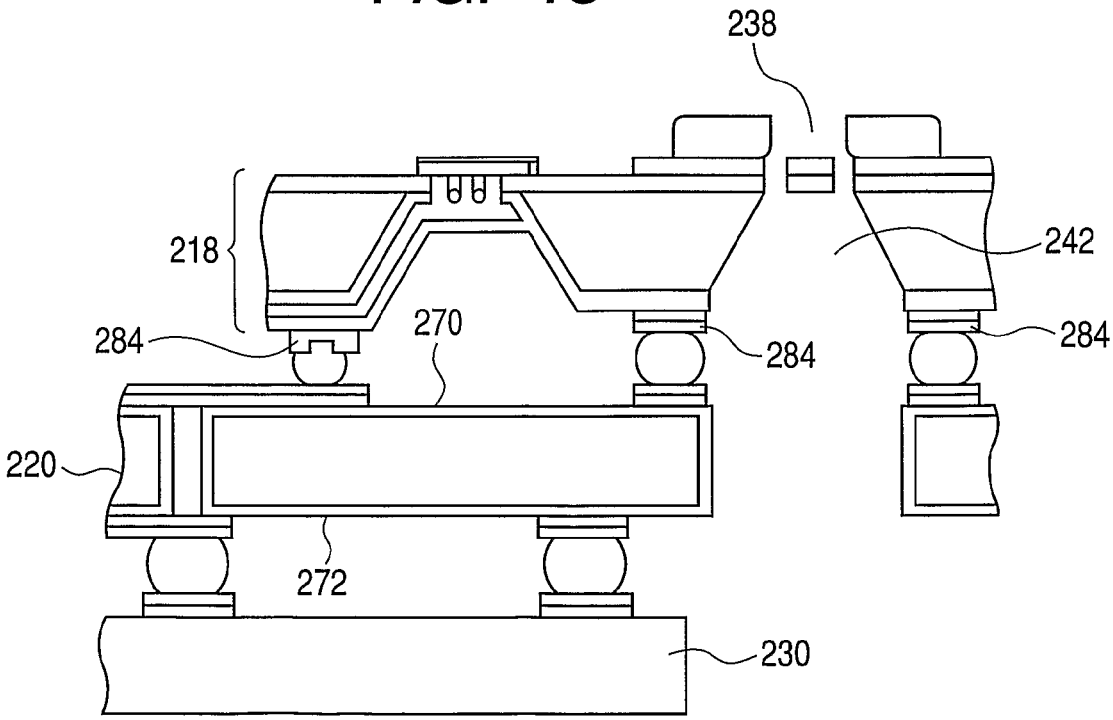
FIG. 18 is a sectional view that shows a part of the wide array ink jet pen including print head dies and a support substrate, and that shows an electrical connection portion of a wide array ink jet print head shown in FIG. 17.

As a fifth embodiment of the present invention, a liquid discharge recording device on which the above-stated recording head can be mounted will be described. FIG. 16 is an explanatory view that shows one example of the recording device on which the ink jet recording head according to the present invention can be mounted.

In the recording device shown in FIG. 16, the recording head H1001 shown in FIG. 1 or 9 is positioned relative to a carriage 102 and mounted thereon to be replaceable. The carriage 102 includes an electrical connection portion (not shown) for transmitting a drive signal or the like to each discharge port row through the electrical connection portion on the recording head H1001.

The carriage 102 is guided and supported to be able to make a reciprocating motion along a guide shaft 103 provided in a device main body to extend in a main scan direction. The carriage 102 is driven by a main scan motor 104 through a driving mechanism such as a motor pulley 105, a driven pulley 106, and a timing belt 107, and a position and a motion of the carriage 102 are controlled. A home position sensor 130 is provided on the carriage 102. This home position sensor 130 makes it possible to grasp a position of a shielding plate 136 when the home position sensor 130 on the carriage 102 passes through the shielding plate 136.

A cap 137, which closes a front surface of the recording head H1001 in which the discharge port is formed, is arranged at a position (home position) of the carriage at which the home position sensor 130 detects the shielding plate 136. The cap 137 is used to absorb and recover the ink of the recording head through an inner opening of the cap by absorbing means (not shown). The cap 137 is moved by a driving force transmitted through a gear and the like and can cover up the ink discharge port surface of the recording head. A cleaning blade 138 is provided near the cap 137. The device is configured so that the capping, the cleaning, and the absorption and recovery can be performed on the ink discharge port surface of the recording head when the carriage 102 is moved to the home position.

Recording mediums 108 such as recording sheets or plastic thin plates are separated and fed one by one from an auto sheet feeder (hereinafter, "ASF") 132 by causing a sheet feed motor 135 to rotate pickup rollers 131 through gears. Further, by rotating transport rollers 109, each recording medium 108 is passed through a position (a print section) opposite to the discharge port surface of a head cartridge 1 and transported (subjected to a sub-scan). The transport rollers 109 are rotated through a gear by an LF motor 134. Determination as to whether the recording medium 108 has been fed and confirmation of a heading position during sheet feed are performed when the recording medium 108 is passed through a paper end sensor 133. The paper end sensor 133 is also used to determine where a rear end of the recording medium 108 is actually present and to finally calculate a present recording position of the recording medium 108 from the actual rear end thereof.

A back surface of the recording medium 108 is supported by a platen (not shown) so as to form a flat print surface thereof in the print section. In this case, the head cartridge 1 mounted on the carriage 102 is held so that the discharge port surface of the head cartridge 1 protrudes downward from the carriage 102 and is parallel to the recording medium 108 between the two pairs of transport rollers.

The recording head H1001 is mounted on the carriage 102 so that an alignment direction of the discharge ports in each discharge port row crosses the scan direction of the carriage 102. The recording head H1001 performs recording while discharging the liquid from these discharge port rows.

In the above-stated embodiments, the recording head includes the electric-to-thermal converter element that generates thermal energy so as to discharge the ink using the thermal energy. Needless to say, the present invention is applicable to other discharge methods, such as a discharge method for discharging the ink using an oscillator element.

The present invention can be applied to a device such as a copying machine, a facsimile machine including a communication system, or a word processor including a print section, or an industrial recording device combined with various processors for multifunction purposes as well as an ordinary printer device.

This application claims priority from Japanese Patent Application No. 2004-214240 filed Jul. 22, 2004, which is hereby incorporated by reference herein.

The invention claimed is:

1. An ink jet recording head comprising:

a liquid discharge substrate that includes a discharge port for discharging a liquid to a surface of the liquid discharge substrate, a liquid supply port for supplying the liquid discharged from the discharge port to a back surface of the liquid discharge substrate, and an electrode for transmitting and receiving a signal for driving energy generating means for discharging the liquid from the discharge port;

a film-like electrical wiring member that is joined with the back surface of the liquid discharge substrate, and that includes a liquid supply port communicating with the liquid supply port of the liquid discharge substrate and an electrical connection portion connected to the electrode; and a holding member that holds the liquid discharge substrate through the electrical wiring member, and that includes a liquid supply port for supplying the liquid to the liquid supply port of the liquid discharge substrate, wherein the liquid supply port of the electrical wiring member, the liquid supply port of the liquid discharge substrate, and the liquid supply port of the holding member communicate with one another, a sealing agent for sealing the electrical connection portion is filled up between the liquid discharge substrate and the electrical wiring member, and a side surface of the liquid supply port of the electrical wiring member is covered with the sealing agent.

2. The ink jet recording head according to claim 1, wherein the liquid support port of the electrical wiring member, the liquid supply port of the liquid discharge substrate, and the liquid supply port of the holding member coincide with one another in center line, and the liquid supply port of the electrical wiring member is larger than the liquid supply port of the liquid discharge substrate and the liquid supply port of the holding member.

3. An ink jet recording apparatus comprising:

the ink jet recording head according to claim 2; and a head holding member that holds the ink jet recording head so that the ink jet recording head faces a recording medium.

4. The ink jet recording head according to claim 1, wherein the electrical wiring member is a flexible wiring substrate configured so that wiring layers are formed on both surfaces of a base film, respectively.

5. An ink jet recording apparatus comprising:

the ink jet recording head according to claim 4; and a head holding member that holds the ink jet recording head so that the ink jet recording head faces a recording medium.

6. An ink jet recording apparatus comprising:

the ink jet recording head according to claim 1; and a head holding member that holds the ink jet recording head so that the ink jet recording head faces a recording medium.

* * * * *